United States Patent [19]

Holderegger et al.

[11] Patent Number: 4,967,655

[45] Date of Patent: Nov. 6, 1990

[54] APPARATUS FOR SCREEN PRINTING INCLUDING A PNEUMATICALLY CONTROLLED TENSIONING DEVICE FOR EXCHANGEABLE FLEXIBLE PRINTING SCREENS

[75] Inventors: Jurg Holderegger, Datwil; Dionizy Simson, Winterthur, both of Switzerland

[73] Assignee: Jurg Holderegger, Datwil, Switzerland

[21] Appl. No.: 455,852

[22] Filed: Dec. 19, 1989

Related U.S. Application Data

[63] Continuation of Ser. No. 218,290, Jun. 15, 1988, abandoned.

[30] Foreign Application Priority Data

Oct. 29, 1986 [CH] Switzerland ..... 04285/86

[51] Int. Cl.[5] ..... B41F 15/34

[52] U.S. Cl. ..... 101/128.1; 101/415.1; 269/22

[58] Field of Search ..... 101/127.1, 128.1, 415.1, 101/116, 114; 269/20, 22

[56] References Cited

U.S. PATENT DOCUMENTS

| | | | |
|---|---|---|---|
| 2,026,906 | 1/1936 | Morrell et al. | 101/116 |
| 2,218,451 | 10/1940 | Heyne | 101/127.1 X |
| 3,058,417 | 10/1962 | Norlin | 101/415.1 |
| 3,151,400 | 10/1964 | Schmitt | 101/127.1 X |
| 3,303,777 | 2/1967 | Feier et al. | 101/127.1 |
| 4,284,349 | 8/1981 | Beasley et al. | 355/79 |
| 4,505,199 | 3/1985 | Hasegawa et al. | 101/127.1 |
| 4,729,306 | 3/1988 | Bubley | 101/127.1 |

FOREIGN PATENT DOCUMENTS

| | | | |
|---|---|---|---|
| 1802686 | 3/1978 | Fed. Rep. of Germany | 101/127.1 |
| 238946 | 9/1986 | Fed. Rep. of Germany | 101/127.1 |
| 8403662 | 9/1984 | PCT Int'l Appl. | 101/127.1 |

*Primary Examiner*—Clifford D. Crowder

*Attorney, Agent, or Firm*—Kenyon & Kenyon

[57] ABSTRACT

The mounting of the flat flexible printing screen is such that printing stencils can be applied in a correct position and practically without distortion on the printing screens. The screens are then mounted in the correct position in a stretching of printing frame or on a rotatable printing cylinder. The printing screen is secured at opposite ends to stiffening profiles which can be clamped in clamping devices on the printing frame or printing cylinder and can be stretched by moving one of the clamping devices. The printing screen may also be similarly mounted on a copying frame and a transfer frame.

17 Claims, 11 Drawing Sheets

APPARATUS FOR SCREEN PRINTING INCLUDING A PNEUMATICALLY CONTROLLED TENSIONING DEVICE FOR EXCHANGEABLE FLEXIBLE PRINTING SCREENS

This application is a continuation of application Ser. No. 07/218,290, filed Jun. 15, 1988, now abandoned.

The invention relates to an apparatus for screen printing including flat, flexible printing screens which are stretched in a printing frame or on a printing cylinder and are pressed locally against the material to be printed by a printing wiper which sweeps across it, the printing screen being connected, preferably by adhesive, on two opposing sides, which extend transverse to the direction of movement of the wiper, to stiffening profiles and being stretchable in the direction of movement of the wiper, that is to say perpendicular to the stiffening profiles.

Screen printing renders possible the printing or coating of very different materials with widely varying printing media. It can be performed with flat, planar printing frames or with rotating printing cylinders.

Rotating screen printing machines are known for screen printing—primarily for printing textiles and printing labels roll by roll—which print with endless metallic, primarily nickel, cylinder screens. With these known cylinder screens one is tied to the standard sizes common in the trade, that is to say to a fixed periphery. Furthermore, special devices are absolutely necessary for the coating and the copying. The handling of the cylinders is complicated and they are therefore very susceptible to damage by pressure or impact. These disadvantages strongly limit the usage of such endless cylinder screens.

The use of flat metallic or carbon fibre screens in conjunction with planar screen printing frames of conventional construction, with which the screen is connected to the frame on all sides, is closely restricted as regards printing format since the necessary screen jump can only be very small as a consequence of the inextensibility of the screen. This limitation to small printing formats also strongly limits the use of planar screens.

In addition, a screen which is stretched from all sides deforms under the pressure of the wiper, depending upon the position of the latter, in a widely varying manner which impairs the printing quality. The screen tension also decreases after a certain time and cannot be returned to the precise original value which renders an exact reproduction of the printed image impossible. A screen stretched from all sides on a screen printing frame cannot be used for rotational screen printing. Such screens necessitate high expense for the provision of the necessary screen printing frame, the stretching operation and the large space requirement for storage.

U.S. Pat. No. 3,303,777 discloses a mounting for a printing screen of the type described above for fixing to a screen printing machine; in this mounting provided with a stretching means the screen is connected to two stiffening profiles on two opposing sides; this screen can be stretched in a direction perpendicular to the stiffening profiles. Since the stretching device only engages at individual points on the profiles, the screen distorts during stretching and faults occur in its surface.

It is the object of the invention to eliminate these disadvantages and to provide a printing screen for screen printing which may be used not only for flat but also for rotational screen printing and may be stretched without distortion or twisting whereby the stretching may be controlled and reproduced.

Briefly, the invention provides a printing frame or a printing cylinder with a fixed clamping device and a clamping device movable in the direction of movement of a wiper for the reception of stiffening profiles, which are uniformly loaded over their entire length, being clamped in the clamping devices and further that the movable clamping device, which is also uniformly loaded over the entire length of the stiffening profiles, may be stressed in the direction of movement of the wiper.

The apparatus permits a distortion, twisting and fault-free stretching of the screens by virtue of the clamping devices with the action of forces distributed uniformly over their length and by virtue of the distribution of the stretching forces also over the entire length of the stiffening profiles; the same screens can be used not only on flat screen printing frames but also on rotating printing cylinders so that these screens can be used in a compatible manner on practically all screen printing machines of the type common in the trade. The distribution of the pressing forces of the printing wiper in the new apparatus is also precisely definable and approximately uniform over the entire printing length and printing breadth.

An advantageous construction of the clamping device results if each clamping device is provided with a fixed and a movable jaw which are displaceable relative to one another in the direction of movement of the wiper and extend over the entire breadth of the printing screen, whereby the movable jaw may be pressed against the fixed jaw by mechanical means—such as screws, wedges or eccentrics—or by pneumatic or hydraulic means, whereby the pressing means comprises with particular advantage a pressurised tube filled with a gas or a liquid.

The positional accuracy mentioned above may be achieved if—in a manner known per se (U.S. Pat. No. 4,284,349)—the printing screen is provided in the region of both stiffening profiles with index holes which can receive index pegs on the printing frame or printing cylinder in a precisely fitting manner, whereby it can be additionally provided that the copying and the coating and transfer frame are provided with identical loadable clamping devices and with identical index pegs.

A simplification of the handling and a protection of the screen edges can be achieved by the use of a handling frame which is provided with a fastening mechanism for locking with the stiffening profiles.

An economical storage of used printing screens is possible if at least one of the stiffening profiles is provided with at least one projection for sliding into a storage stand. The screens which have been slid laterally into a comb-like structure of such a stand then hang with their free end downwardly. Notches extending transversely to the projections of the stiffening profiles can serve to fix movable indicators.

The use of the new apparatus on a printing cylinder is facilitated when its recess for the printing screen is defined in the direction of the cylinder axis by two annular discs and in the peripheral direction of the cylinder by wedge profiles, whereby elastomeric seals are advantageously embedded in grooves on the cylindrical periphery of the discs and on the outer surface of the wedge profiles.

The process of copying can be facilitated if the film mounting plate is provided with the same index pegs as the other elements and if it has markings for the printing format, the centre and the diagonals of the printing surface and/or a grid on the decimal or imperial system and/or if the copying and the coating and transfer frame are mounted in a stand to be pivotable about a horizontal central axis, whereby the stand can additionally be equipped with a pivotal brake.

The invention will be described below with reference to the exemplary embodiments in conjunction with the drawings, in which.

Figure 3:
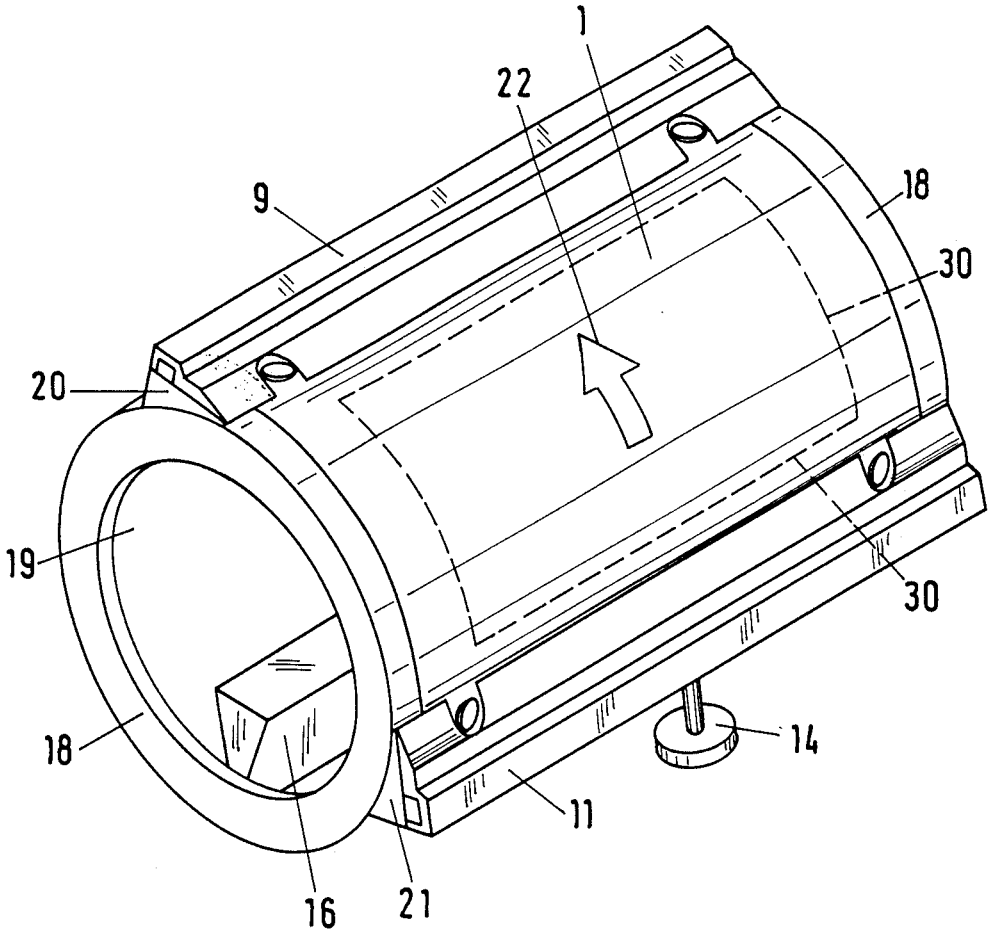
FIG. 3 shows a printing screen stretched on a printing cylinder.
Figure 6:
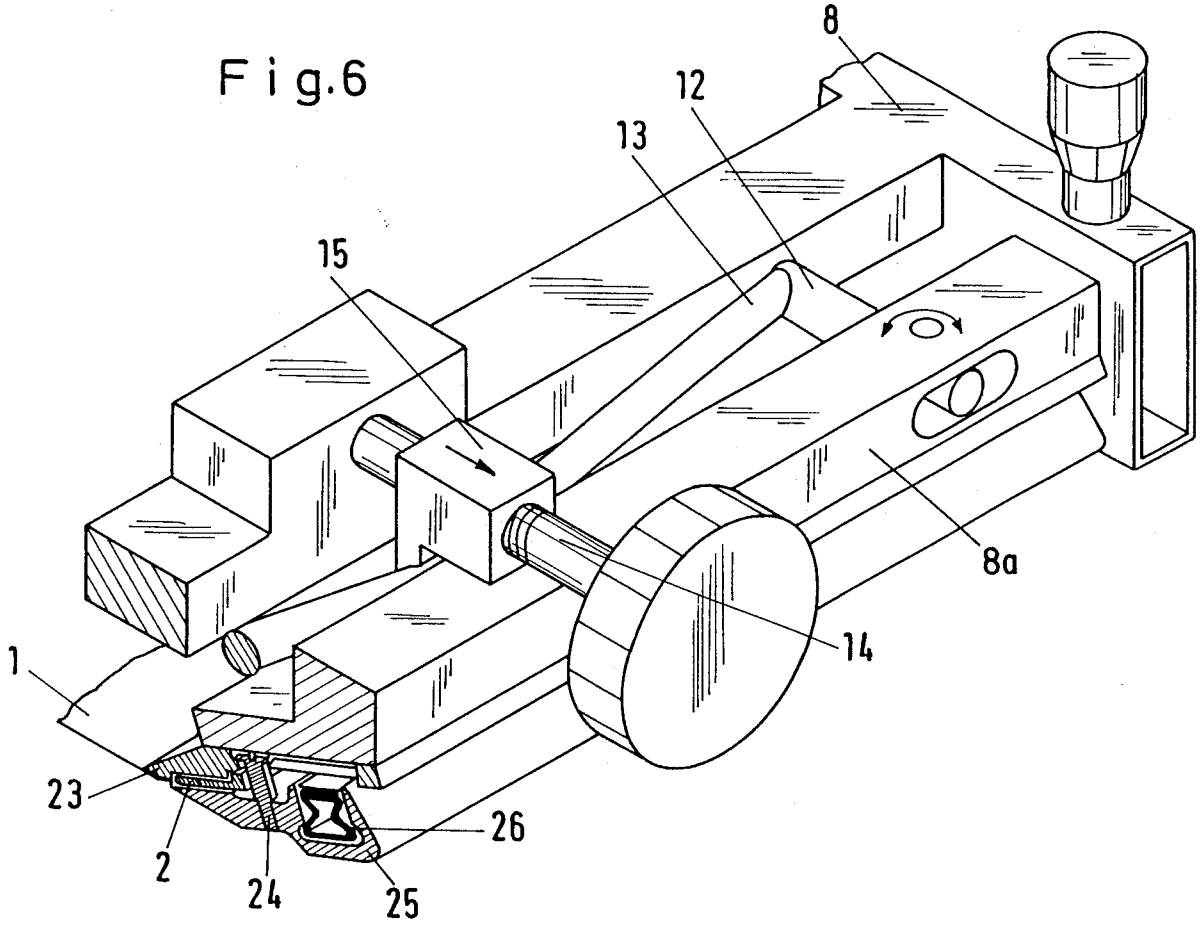
FIG. 6 is a cross-section through a movable clamping device and the associated stressing device.
Figure 6A:
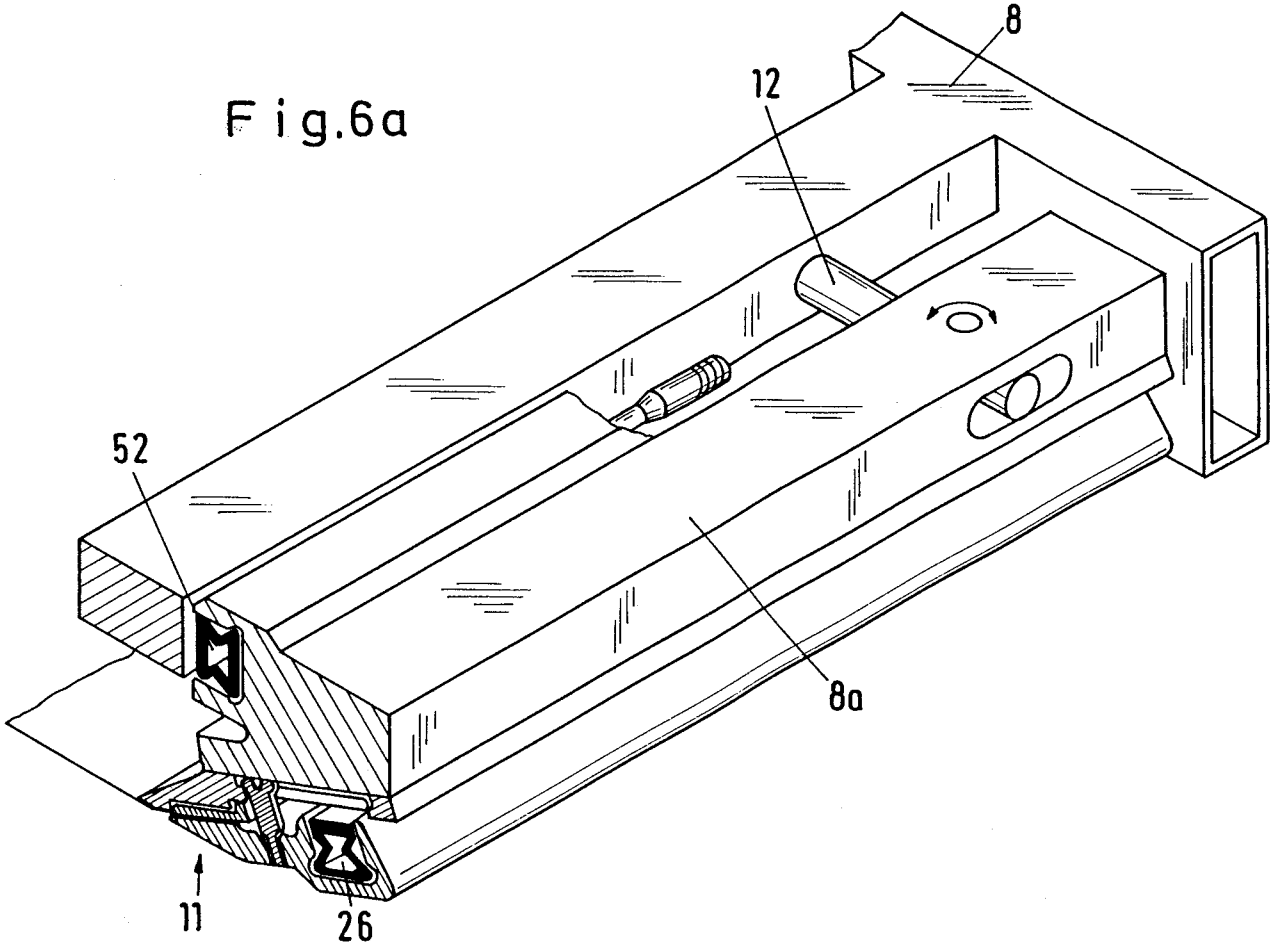
Figure 7:
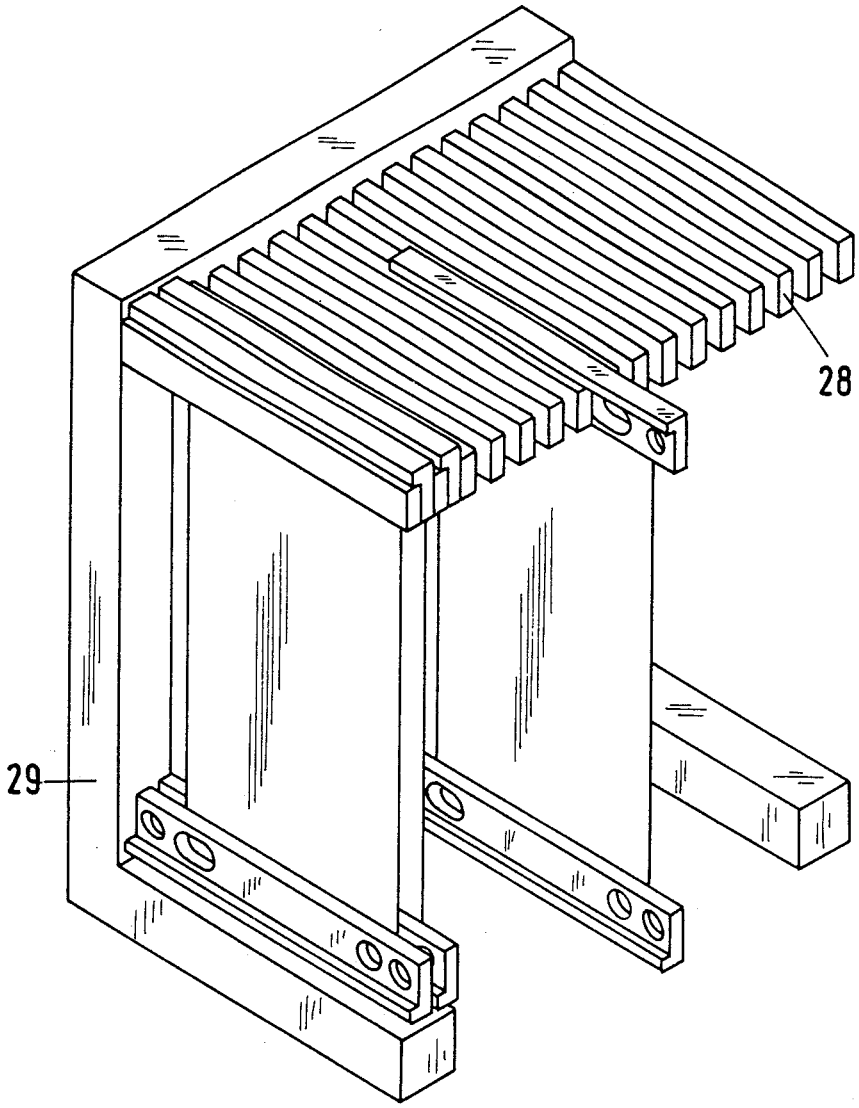
Figure 8:
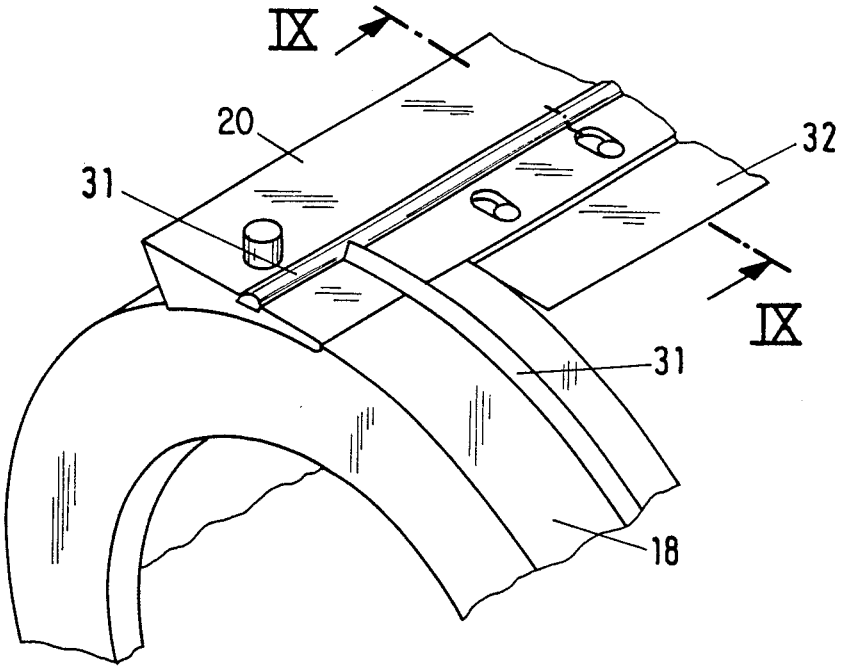
Figure 9:
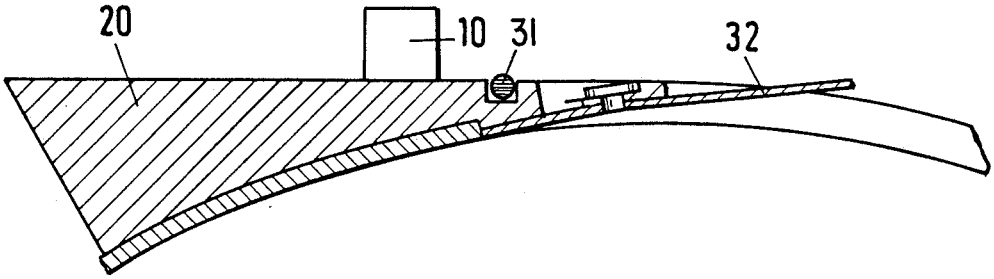
Figure 10:
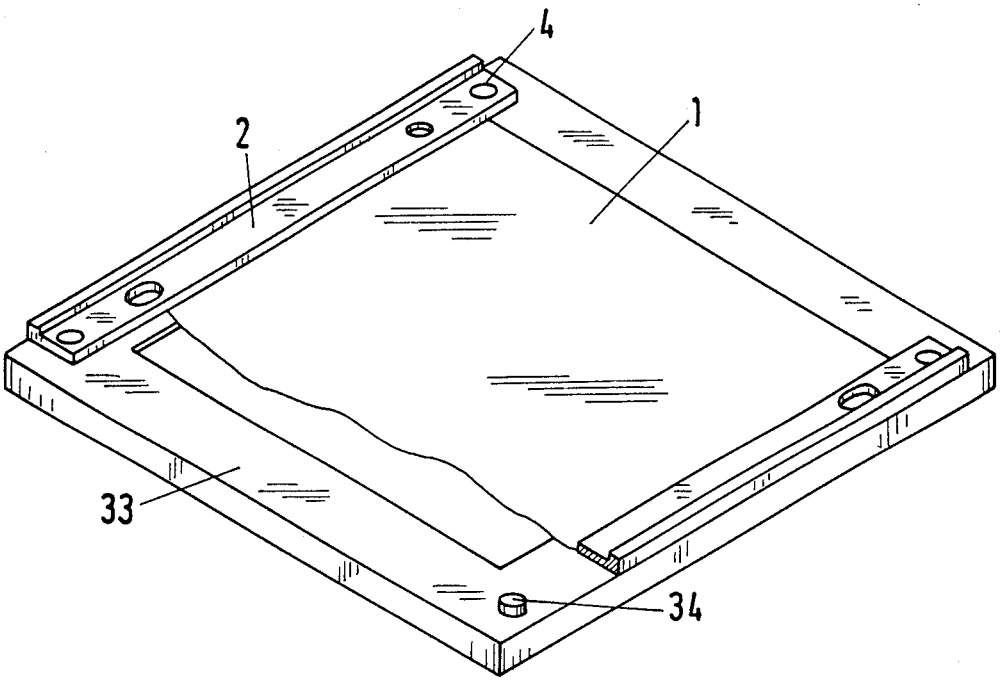
Figure 11:
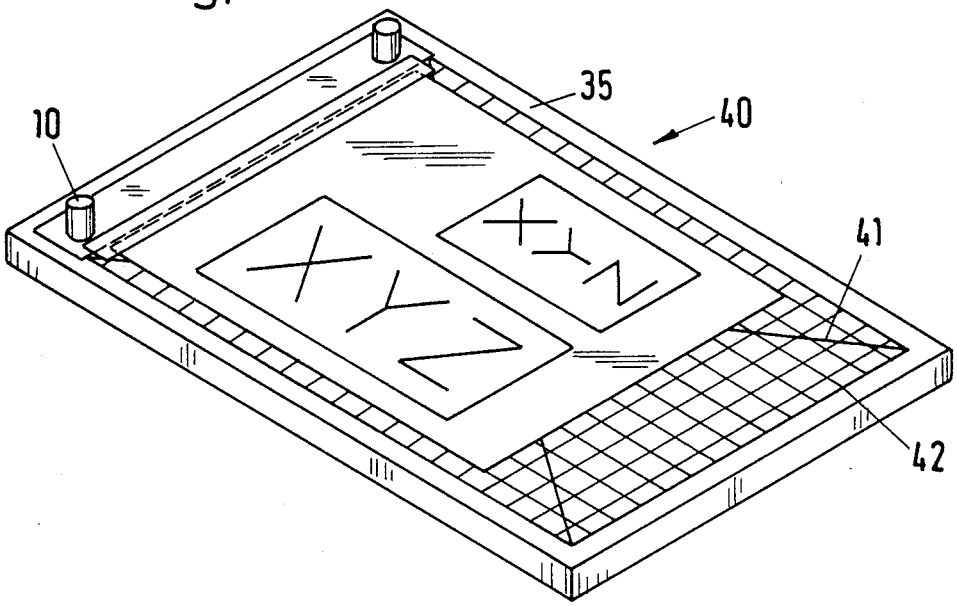
Figure 12:
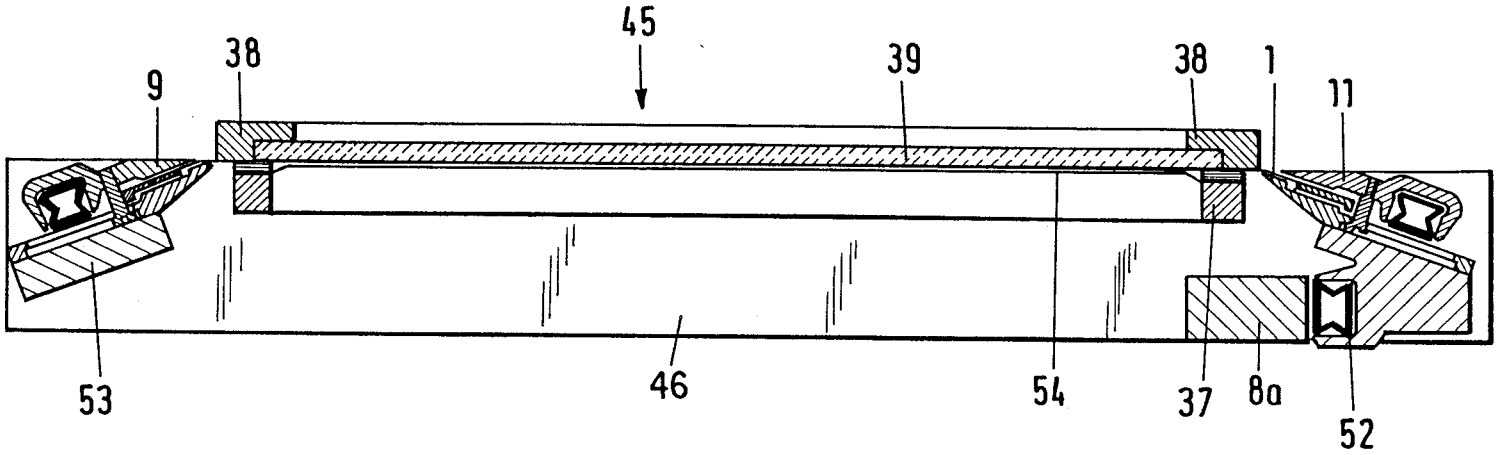
Figure 13:
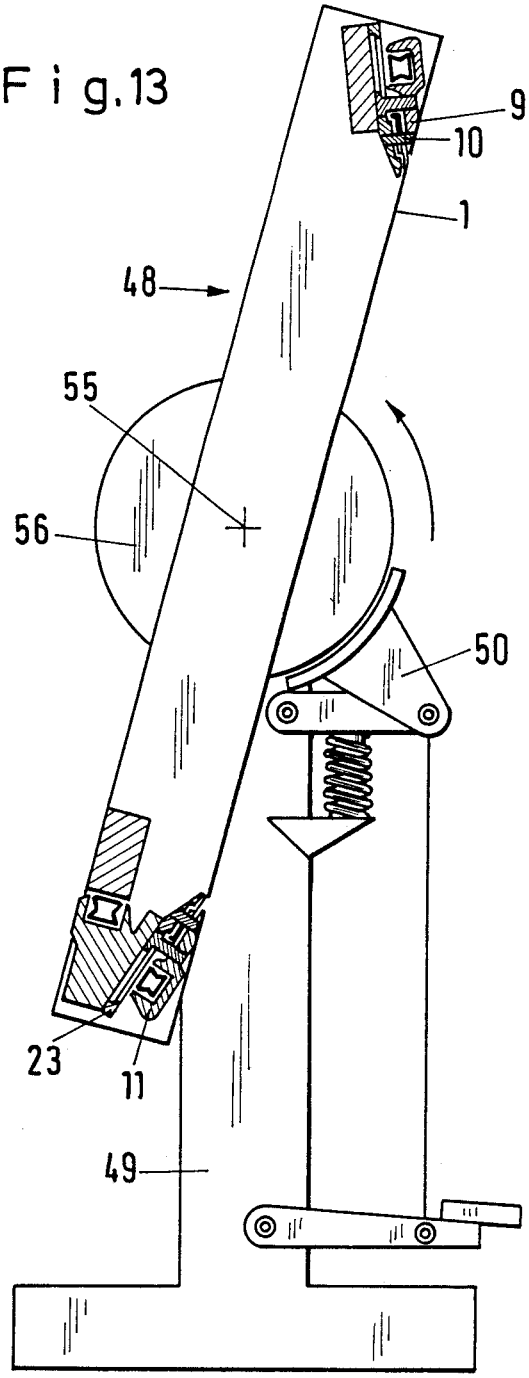

FIG. 6*a* shows in similar representation to FIG. 6 the movable clamping device with a second embodiment of the stressing device;

FIG. 7 shows a storage stand with printing screens hanging within;

FIG. 8 is an enlarged fragmentary view of the printing cylinder of FIG. 3;

FIG. 9 is the section IX—IX from FIG. 8;

FIG. 10 shows a handling frame for a printing screen;

FIG. 11 is a view of a film mounting plate in which there is a film mounting profile with a film mounting foil and a mounted film;

FIG. 12 is a section through a copying frame with an inserted copy pattern and an inserted printing screen;

FIG. 13 shows a coating and transfer frame pivotally mounted on a stand provided with a pivotal brake.

Figure 1:
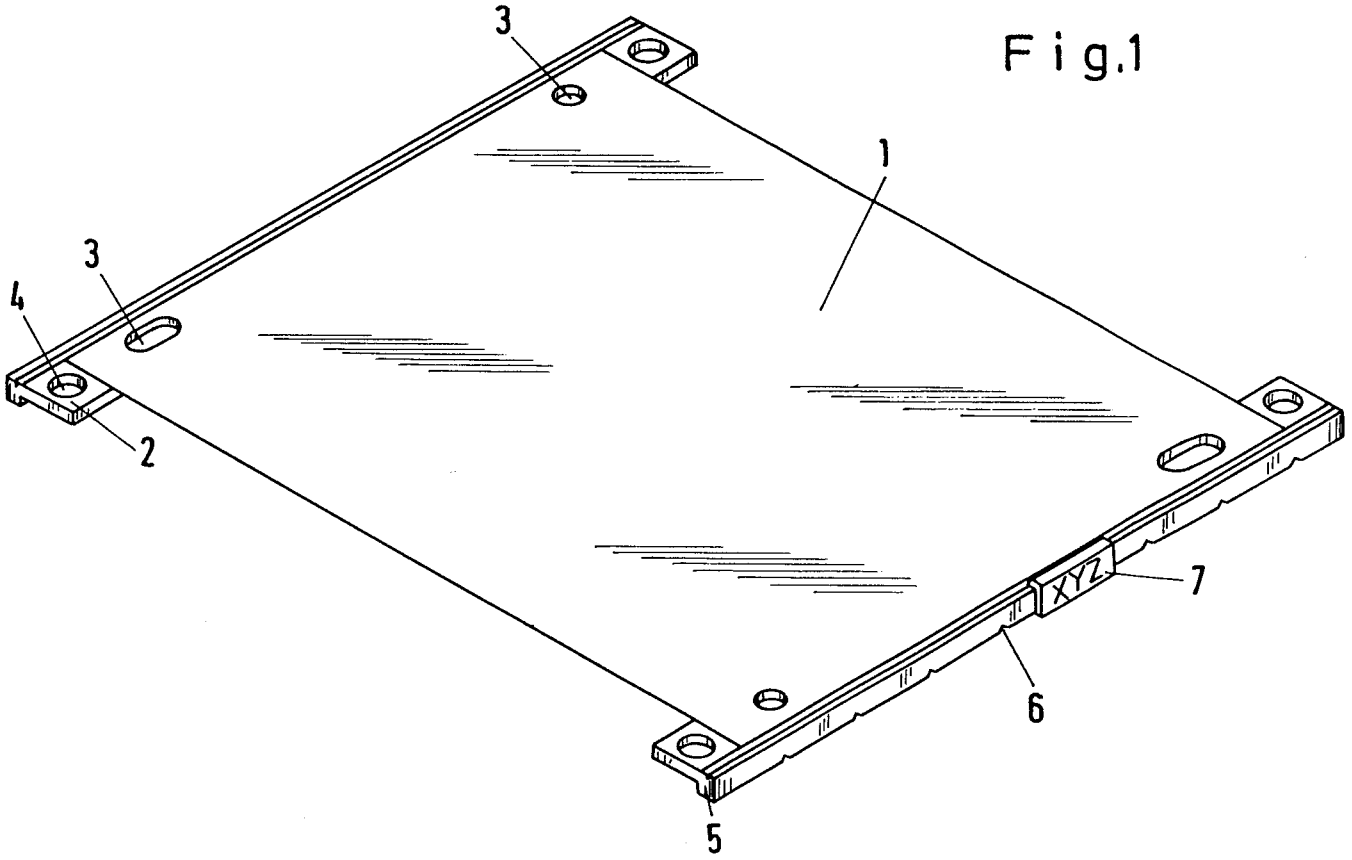
FIG. 1 shows a printing screen with stiffening profiles and index holes.

Referring to FIG. 1, a rectangular, planar, flexible and porous printing screen 1 is provided on two sides with stiffening profiles 2 to which it is secured over the entire length, for instance by adhesive, in a distortion and fault-free manner. In the vicinity of each profile 2 there are two index holes 3. The stiffening profiles 2 have a projection 5 in which transverse notches 6 for moving indicators 7 are provided which engage in the notches 6.

Figure 2:
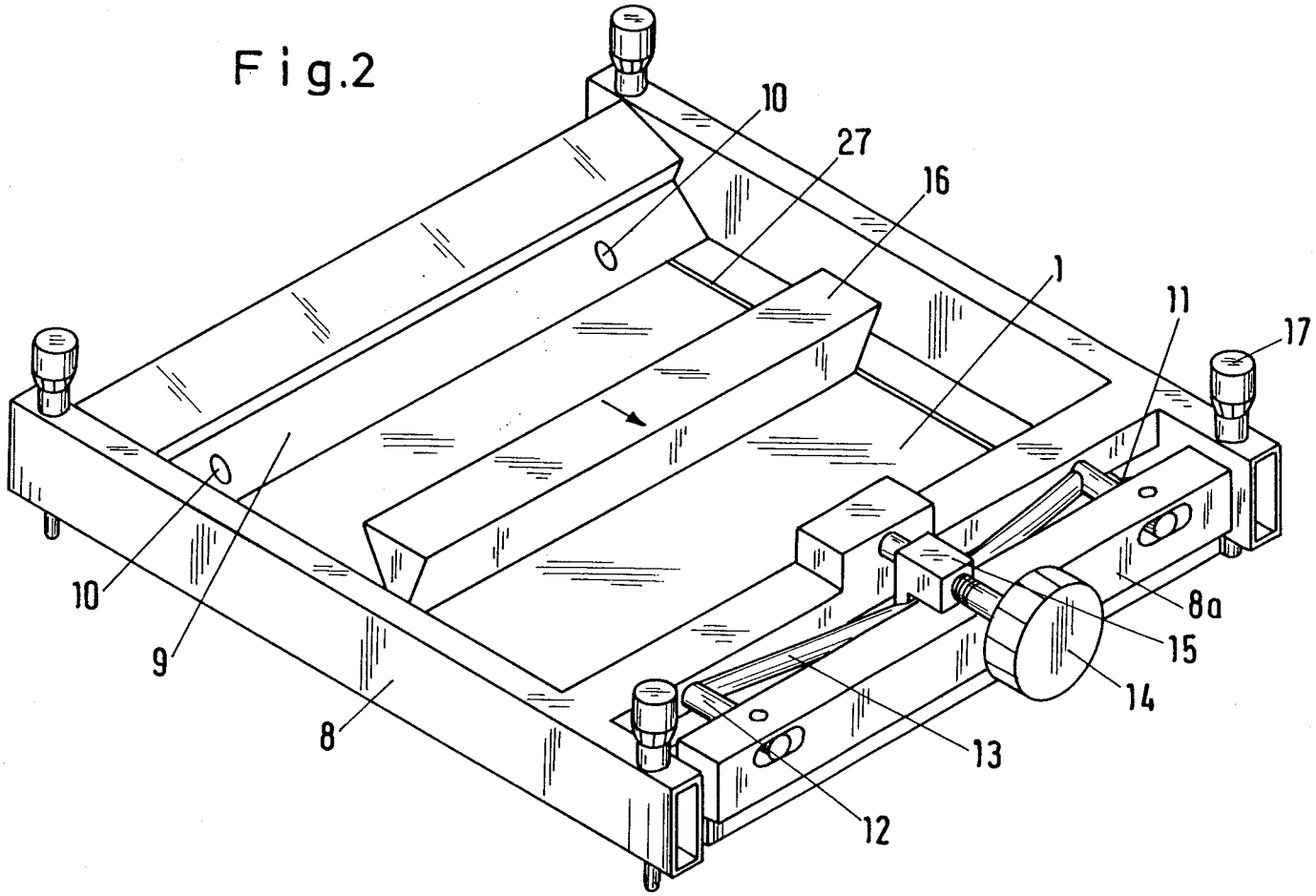
FIG. 2 shows a printing screen stretched within a flat stretching and printing frame.

Referring to FIG. 2, a flat, rectangular stretching and printing frame 8 comprises substantially rigid hollow profiles to which two clamping devices 9 and 11 are secured. The clamping device 9 is fixedly connected to the frame 8 and carries two index pegs 10. The clamping device 11, which also has two index pegs 10 (not shown), sits fixedly on an intermediate beam 8*a* which in turn is movable with respect to the frame 8, whereby it is guided with guide pegs 12 secured to it in one side of the frame 8. With the aid of the movable intermediate beam 8*a*, the clamping device 11 can be moved by a stressing device perpendicular to the stiffening profiles 2, i.e. in the direction of movement of the wiper, so that the printing screen 1 is stretched. To compensate for small inaccuracies in the parallelism of the two clamping devices 9 and 11, the intermediate beam 8*a* can additionally be pivoted by a small amount about an axis perpendicular to the frame surface. A spring 13 and a threaded spindle 14 with a hook 15 form a first embodiment of the stressing device for the printing screen 1 with which the latter is controllably and resiliently stretched. As illustrated, the spring 13 serves to bias the intermediate beam 8*a* away from the frame 8 while the threaded spindle 14 is used to move the intermediate beam 8*a* against the force of the spring 13.

Referring to FIG. 6*a*, wherein like reference characters indicate like parts as above, the stressing device is in the form of a pressurised tube 52 which is acted upon by a gaseous or liquid pressure medium with a pressure of, for instance, 3 bar so that it displaces the intermediate beam 8*a* and thus stretches the printing screen 1 with a force which is uniform over its entire length.

As shown in FIG. 2, the working surface in the printing screen is limited by elastic profiles 27 secured thereto by adhesive and the frame 8 is movable vertically with the aid of four micrometer screws 17. A printing wiper 16 presses from the fixed clamping device 9 in the direction towards the movable clamping device 11.

Referring to FIG. 3, wherein like reference characters indicate like parts as above, a printing cylinder, which has a recess 30 for the accommodation of the printing screen 1, comprises two annular discs 18 with a smooth interior which are connected together by means of a shell 19 and two wedge profiles 20 and 21. The fixed clamping device 9 is secured to the wedge profile 20; the wedge profile 21 carries the movable clamping device 11, along with the (not shown) intermediate beam 8*a* with the guides 12 and the stressing device 13–15. The printing cylinder 18,19 rotates in its mounting, which is not illustrated, in the direction of the arrow 22, whereby in turn a relative movement of the fixed printing wiper 16 of the fixed clamping device 9 takes place in the direction towards the movable clamping device 11.

Figure 4:
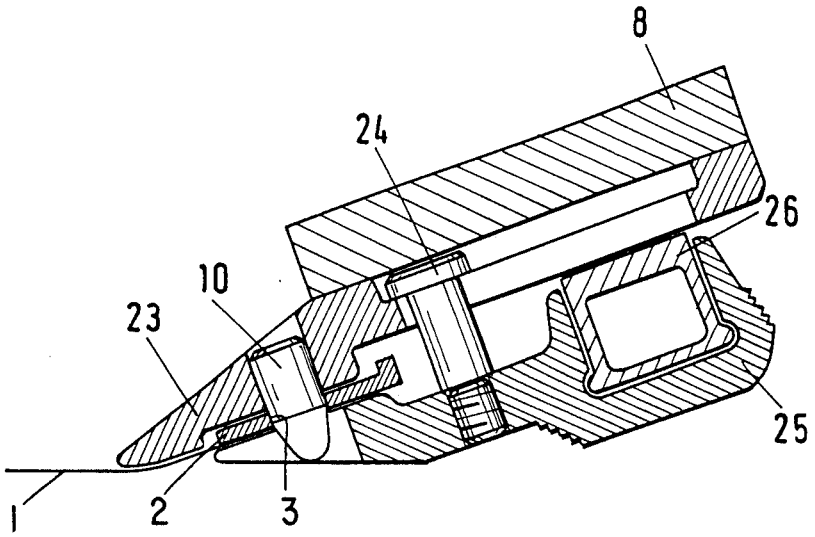
FIG. 4 is a cross-section through a clamping device in the closed state.
Figure 5:
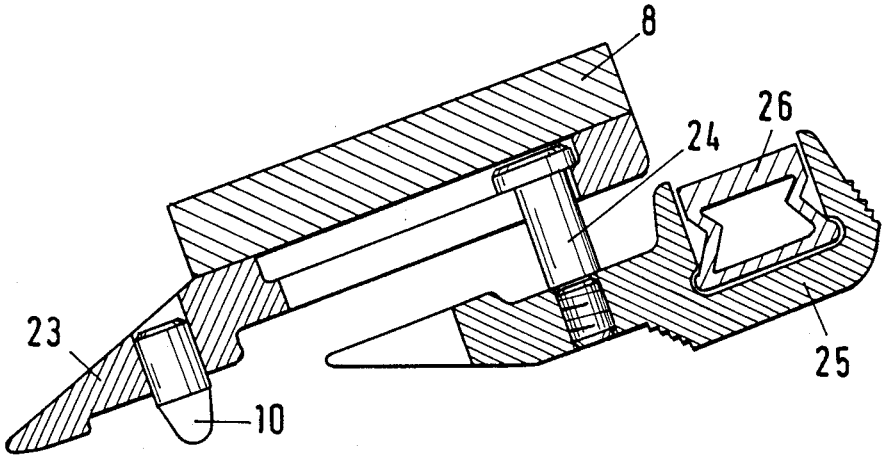
FIG. 5 is a cross-section through a clamping device in the open state.

Referring to FIGS. 4 and 5, a clamping device 9 or 11 comprises in the present exemplary embodiment two elongate profiles which are displaceable relative to one another. One of these profiles forms a fixed jaw 23 which is immovably connected to the flat printing frame 8 or the printing cylinder 18,19. A plurality of pegs 24, which are provided with a head, move parallel to the printing direction in elongate grooves in the profile 23 and are rigidly connected to a movable jaw 25, which is provided with a tube 26, which can be placed under a pressure of, for instance 3 bar by a gaseous or liquid pressure medium. By virtue of the pressure in the tube 26, the movable jaw 25 is acted on by a torque whose axis is at approximately the height of the pegs 24. The end of the movable jaw 25 directed towards the fixed jaw 23 is thus pressed against the fixed jaw 23 whereby the stiffening profiles 2 of the printing screen 1 (FIG. 4) are clamped with a force which is uniform over the entire length. The fixed jaws 23 of each clamping device are provided at their ends with the index pegs 10 which fit into the index holes 3 of the profiles 2.

Referring to FIG. 7, a printing screen storage rack 29 is also provided for hanging of the individual printing screens. As indicated, the rack 29 is a laterally open comb-like structure having narrow profiles 28 at the top between which the profiles of the respective printing screens can be slidably mounted.

Referring to FIGS. 8 and 9, the recess 30 for the screen 1 in the printing cylinder 18,19 is edged by elastic profiles 31 which are disposed in grooves in the two discs 18 and the two wedge profiles 20,21. The transition between the wedge profiles 20,21 and the stretched printing screen 1 is covered by removable, elastic strips 32.

A handling frame 33 (FIG. 10) is a light, rectangular structure of hollow profiles which is provided with not illustrated fastening mechanisms for fixing the stiffening profiles 2.

Referring to FIG. 11, a film mounting plate or bunch registration mounting 40 comprises a massive base plate 35 with index pegs 10 and—for instance drawn, printed or engraved—markings 41 for printing format, centre and diagonals of the printing surface or optionally a grid division 42 on the decimal or imperial system.

Referring to FIG. 12, wherein like reference characters indicate like parts as above, a copying frame 45 includes two massive frames 37 and 38 which are connected by means of hinges and which are fixed in an outer frame 46. The latter is similar in its construction and corresponds in its dimensions to the printing frame 8; similarly to the latter it is equipped with two clamping devices 9 and 11, whereby the clamping device 11 is again movable so that with its assistance the printing screen 1 can be stretched within the copying frame 45, for instance by means of a stressing device, as is shown in FIG. 6*a*. The printing screen 1 is laid between an extensible, rubber-like coating 54, which is connected in a gas-tight manner to the frame 37, and a glass plate 39, which is anchored in the frame 38. A reduced pressure can be produced in a known manner between the frames 37 and 38 whereby the screen 1 and the coating 54 are pressed completely flat on the glass plate 39.

Referring to FIG. 13, wherein like reference characters indicate like parts as above, a layer and film transfer frame 48 comprised of a printing frame 8 with index pegs 10, clamping devices 9 and 11 and a stressing device can be mounted, as the copying frame 45, in a stand 49 to be rotatable about a horizontal axis 55. Copying frame 45 and coating and transfer frame 48 can be fixed in the stand 49 in any position with the aid of a pivotal brake or locking device 50 which engages a disc 56 rigidly connected to the axis 55.

The working procedure with the new apparatus is described below:

Referring to FIG. 11, a film mounting foil with the film mounting profile, which is provided with index holes 3, is firstly suspended from the index pegs 10 of the film mounting plate 40 and the film pattern correctly mounted on it with the aid of the markings 41 on the mounting plate 40. This copying pattern is subsequently laid on the index pegs 10 of the copying frame 45 (FIG. 12).

A printing screen 1 which has been cut to size is connected on two sides by adhesive to stiffening profiles and then four index holes 3 are stamped out. A thus constructed screen 1 is then cleaned and suspended in the pivotable and lockable layer- or coating- and transfer frame 48 (FIG. 13) which is equipped with the same index pegs 10, the same clamping devices 9 and 11 and a same stressing device as a flat printing frame 8, is clamped in position and stretched, whereby the screen 1 is ready for absorbing an indirect stencil film or for processing by means of direct copy layers, capillary or composite stencils.

For direct stencils or direct emulsion systems, capillary direct systems or direct/indirect systems the screen 1 is now coated or optionally a film applied and dried. Subsequently the clamping devices of the coating and transfer frame 48 are opened, the screen 1 suspended in the index pegs 10 of the copying frame 45 (FIG. 12) and exposed to light in contact with the copying pattern. The copied stencil is developed and suspended again in the coating and transfer frame 48 for drying and retouching.

For working with indirect photo stencil systems a correspondingly larger blank of stencil film material is so laid on the copying pattern that an edge strip of one side of the blank lies between the index pegs 10 of the copying frame 45. A further self-adhesive film mounting profile is now fitted on the index pegs 10 of the copying frame 45 and thereby the stencil film positioned secured to the film mounting profile.

The thus copied stencil film is developed and subsequently plugged on the index pegs 10 of the coating and transfer frame 48 which projects forwardly with an overhang. The frame 48 is tilted rearwardly and the stencil film is flattened with the aid of a suitable profile from the top downwardly and thereby transferred positionally correctly. After the drying the tension is relaxed, the fixed clamping device 9 released and the film mounting profile with the film carrier foil hanging on it removed. For covering the open stencil part the fixed clamping device 9 is closed again and the screen 1 again lightly stressed.

The printing screen 1 is now ready for mounting in a flat printing frame 8 or in the printing cylinder 18,19. For this purpose both clamping devices 9 and 11 on the horizontal coating and transfer frame 48 are open; the handling frame 33 is now so laid on the screen 1 that its fastening mechanisms can be firmly locked to the stiffening profiles 2 of the screen 1. With the aid of the handling frame 33 the screen 1 is transported to the printing machine and positioned with the aid of abutments on the printing table below the printing frame 8 or below the printing cylinder 18,19. A lowering of the printing frame 8 with open clamping profiles 9,11 centres the screen 1 in the printing frame 8 by virtue of the index pegs 10. The movable clamping jaws 25 are then moved inwardly and by filling the tubes 26 with a pressurised gas or a pressurised liquid a clamping effect is achieved. Handling frame 33 can without disadvantage remain hanging from the stiffening profiles 2 when printing with flat screens 1, even during the printing process.

When applying or removing a printing screen 1 to or from a printing cylinder 18,19 the synchronous movement between a printing cylinder 18,19 and the printing table can be made use of in that firstly the side of the printing screen 1 which is to be inserted in the fixed clamping device 9 is placed on the index pegs 10 and the locking of the handling frame 33 on this side is released; then the screen 1 is "wound up" on the recess 30 by rotation of the printing cylinder 18,19 and the second stiffening profile 2 clamped in position and removed from the handling frame 33. When removing the screen 1 from the cylinder 18,19 the reverse sequence is performed. A screen 1 clamped in the clamping devices 9,11 can then, for instance, by rotation of the spindle 14 with the aid of the spring 13 be stressed uniformly over the entire length of the stiffening profiles 2 until the desired pre-stressing is achieved.

The height of the screen 1 above the printing base, the so-called screen jump, is set in the flat printing frame 8 with the aid of the four micrometer screws 17. The working surface in the screen 1 can be limited by the securing with adhesive of elastic profiles 27 along the longitudinal edges and along the clamping profiles 9,11. The integrity of the seal to the atmosphere is ensured in the printing cylinder 18,19 by the stressing of the screen 1 in that the screen 1 is pressed against the elastic seals 31 in the grooves in the screen opening edges.

For the purpose of storage the printing screens 1 are suspended by the projection 5 of the stiffening profiles 2 by lateral sliding in between the narrow profiles 28 of the comb-like storage stand 29. Movable indicators 7 enable a systematic arrangement, for instance in a decimally constructed recognition system.

What is claimed is:

1. In combination a flexible printing screen;

a pair of stiffening profiles, each profile being secured to an opposite end of said screen; and a frame having a fixed clamping device for clamping one of said profiles therein, a movable clamping device for clamping the other of said profiles therein, and means for moving said movable clamping device in a direction away from said fixed clamping device to stretch said printing screen, each said clamping device including a fixed jaw secured to said frame, a movable jaw for clamping one of said profiles against said fixed jaw and mean for pressing said movable jaw towards said fixed jaw uniformly over the length of said jaws.

2. The combination as set forth in claim 1 wherein said frame is a flat printing frame.

3. The combination as set forth in claim 1 wherein said frame is a printing cylinder.

4. The combination as set forth in claim 1 wherein said means for pressing includes a pressurized tube in one of said jaws for pivoting one end of said movable jaw towards said fixed jaw to clamp a respective profile therebetween.

5. The combination as set forth in claim 1 wherein each clamping device has at least one pair of index pegs thereon and each profile has a pair of index holes for receiving said pegs.

6. The combination as set forth in claim 1 wherein at least one profile has a projection including a plurality of spaced apart notches and which further comprises a movable indicator movable along said projection for positioning at a respective notch.

7. The combination as set forth in claim 1 wherein said frame includes a pair of annular discs and a cylindrical shell secured to and between said discs, said shell having a recess receiving said printing screen and said discs mounting said clamping devices thereon.

8. The combination as set forth in claim 7 further comprising elastic profiles disposed over said discs and said clamping device.

9. The combination as set forth in claim 7 further comprising a removable elastic strip between a respective clamping device and said screen.

10. The combination as set forth in claim 1 wherein said frame is of flat rectangular shape and includes micrometer screws at each corner thereof for adjusting the height of said frame relative to a reference plane.

11. A clamping device for a printing screen comprising a first elongated jaw having a plurality of projecting pegs for receiving a printing screen thereon;

a second elongated jaw facing said first jaw and having one end for clamping a printing screen between said end and said first jaw;

a plurality of pegs slidably mounted in said first jaw and threaded into said second jaw to permit relative movements between said jaws; and a tube received in said second jaw on a side of said pegs opposite said one end of said second jaw, said tube being expandable from said second jaw under pressure therein to press against said first jaw and to direct said one end of said second jaw towards said first jaw.

12. A clamping device as set forth in claim 11 wherein said end of said second jaw has recesses for receiving said pegs of said first jaw.

13. A clamping device as set forth in claim 11 wherein said tube extends in parallel to said end of said second jaw.

14. A clamping device comprising a first elongated jaw having one end for clamping;

a second elongated jaw facing said first jaw and having one end for clamping against said end of said first jaw;

a plurality of pegs slidably mounted in said first jaw for movement perpendicular to said end of said first jaw, said pegs being aligned in a single row parallel to said end of said first jaw and being threadably mounted in said second jaw to permit relative movements between said jaws towards and away from each other; and means on said second jaw on a side opposite said one end thereof for pressing said second jaw against said first jaw to press said one end of said second jaw towards said end of said first jaw in clamping relation.

15. A clamping device as set forth in claim 14 wherein said means is an expandable tube received in and extending along said second jaw.

16. A clamping device as set forth in claim 15 wherein said second jaw has a groove receiving said tube therein.

17. A clamping device as set forth in claim 14 which further comprises a row of pegs projecting from said end of said first jaw and a row of recesses in said end of said second jaw for receiving said projecting pegs.

* * * * *